United States Patent [19]

Leistner

[11] 4,442,965

[45] Apr. 17, 1984

[54] NAIL FEED MECHANISM

[76] Inventor: Herbert E. Leistner, 167 Sweeney Dr., Toronto, Ontario, Canada

[21] Appl. No.: 255,837

[22] Filed: Apr. 20, 1981

[51] Int. Cl.[3] ..... B25C 1/04

[52] U.S. Cl. ..... 227/136; 227/130

[58] Field of Search ..... 227/120, 130, 136

[56] References Cited

U.S. PATENT DOCUMENTS

| | | | |
|---|---|---|---|
| 3,688,966 | 9/1972 | Perkins et al. | 227/136 X |
| 3,703,981 | 11/1972 | Smith | 227/136 |
| 3,708,097 | 1/1973 | Fisher | 227/136 |
| 3,826,419 | 7/1974 | Maestri | 227/136 |
| 3,854,648 | 12/1974 | Inzoli et al. | 227/136 |
| 3,945,551 | 3/1976 | Sato et al. | 227/136 |
| 4,319,705 | 3/1982 | Geist et al. | 227/136 X |

*Primary Examiner*—Paul A. Bell

[57] ABSTRACT

A nail feed mechanism for use in power operated nailing guns having a strip of nails joined by two lengths of wire at spaced intervals, for feeding the nails from a magazine to a barrel, and having a nail feed channel, a nail feed pawl adjacent to such channel with abutments interengageable with the nails to advance them into the barrel, contoured surfaces on such abutments around which the wires are bent over when the nail is driven in and spacers on the pawl maintaining the nail out of contact with the bent over portions of wire.

9 Claims, 12 Drawing Figures

NAIL FEED MECHANISM

The invention relates to a nailing machine, and in particular to an improved form of nail feed mechanism for such a machine.

A variety of different nailing machines are available, being operated both electrically, and by air, and using a variety of different nailing strips. Some such strips are comprised of nails secured by tape, in other cases the nails are secured with adhesive materials, and in another case, such nails are secured together by parallel wires.

It has been found that maximum efficiency can be obtained by using the longest possible nailing strip, in any given machine. Where such a nailing strip is linear, then a magazine must be provided of a certain limited length, since otherwise the entire machine becomes unwieldly. On the other hand, where the nails can be secured in a drum, in the form of a coil, then a much more compact magazine can be used, and a much larger number of nails can be contained in any one strip. As stated, this drum-type of magazine, storing a coiled nailing strip, is found to be much more efficient and economical in use.

A type of nailing strip used in such a drum-type magazine is the type in which the nails are secured together by two wires, which are spot welded or otherwise fastened to each individual nail. The use of wires enables the nailing strip to be rolled into a coil, and stored in such a drum. The wire, being both flexible and strong, is capable of withstanding substantial stresses in use without breaking down.

The use of two wires for binding the nailing strip is, however, the cause of certain problems in the operation of the nailing gun.

Essentially, a nailing gun consists simply of a magazine for the nails, a feed mechanism for advancing the strip of nails, and a reciprocable plunger, which rises and falls each time the trigger is pressed, thereby driving the end-most nail. In driving such nail, it is also necessary that the nailing strip binding material shall be cleanly broken. Where such material is paper or adhesive, then generally speaking such binding material is broken relatively easily. However, where wires are much stronger, and being flexible, they will not shatter from the impact of the plunger. In fact, the wires break somewhere between two adjacent nails, and two small portions of wire are usually retained on the nail as it is driven into a work piece. It is, in fact, desirable, that the two pieces of wire shall remain on the nail as it is driven in, since in this way such small wire pieces are removed cleanly from the nailing gun. If pieces of wire become separated from the nails, then they can lodge in the nailing gun and cause malfunction, either of the feed mechanism, or the plunger or some other component.

When this occurs, it is necessary to dismantle the nailing gun and revove the piece of wire causing the blackage before the machine can be re-used.

This is what in fact occurs relatively frequently, using nailing strips bound with wire. As a result, nailing machines using the larger drum-type magazines which require wire-bound nailing strips, have not always been completely reliable, and in fact, relatively frequent stoppages are experienced. As a result, such nailing machines while theoretically offering substantial economy, in practice cause various problems, and have not realized their full potential.

One particularly successful form of nailing machine using a drum-type magazine is shown in U.S. Letters Pat. No. 3,945,551. In that machine a feed mechanism is used having a nail feed pawl which pushes each individual nail forwardly into alignment with the reciprocating plunger. In an attempt to solve the problem of cutting the wires between the nails, the feed pawl is provided with a cutting edge, the purpose of which is to cut the wires as the end nail is being driven downwardly by the plunger.

In practice, however, it is found that in spite of the cutting edge, the wires regularly break off near the endmost nail, before they are separated by the cutting edge. The free ends of wire will then remain in the path of the descending nail head. This acts as a shearing member and severs the free ends of wire. The loose portions of wire may then jam the machine.

It is, therefore, a general objective of the invention to provide a nail feed mechanism for use in such a nailing machine, in which the components of the nail feed mechanism are designed so as to ensure that the wires binding the nailing strip are broken cleanly, and that the nail when released, retains two broken pieces of wire attached to it, while it is being driven into the work piece, and does not cut off loose pieces of wire in the process.

More specifically, it is an object of the invention to provide a nail feed mechanism for use in a nailing machine of the type using a wire-bound nailing strip, in which a nail feed pawl is employed having contoured surfaces around which the wires are drawn as the endmost nail is driven downwardly, such contoured surfaces producing a clean break in the wires near the junction with the endmost nail, and leaving the end portions bent over.

Still more specifically, such a nail feed pawl incorporates additional raised surfaces, while the contoured surfaces are relieved, in a manner producing an uneven surface contour on the pawl, which effectively protects the bent over ends of the wires so that they are not broken off by the descending nail head.

It is also an objective of the invention to provide a simplified nail feed mechanism, in which the nail feed pawl is actuated by means of a simplified form of pneumatic cylinder.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
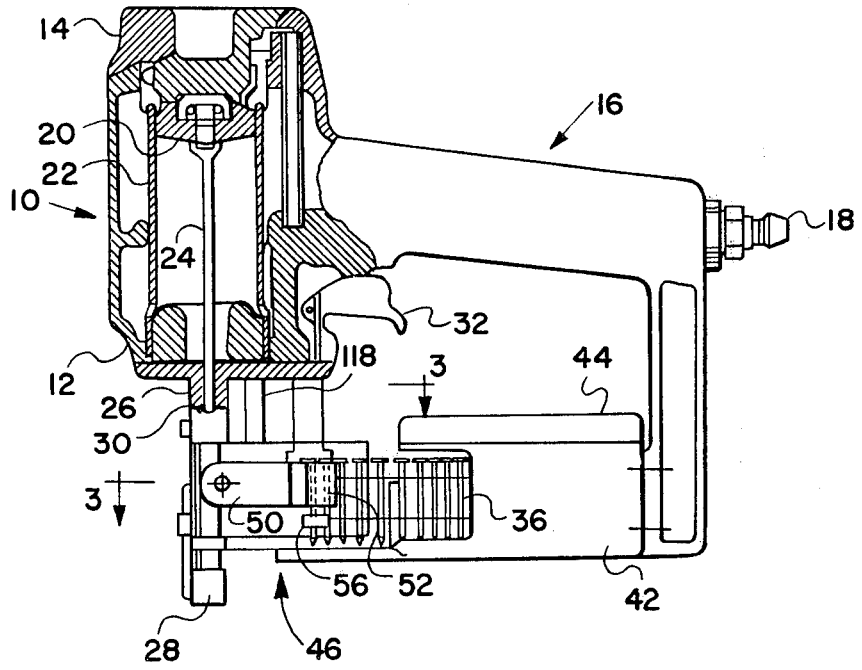
FIG. 1 is a side elevational view of a nailing machine of the general type to which the invention relates, partly cut away to show some details of its construction.

As shown generally in FIG. 1, a typical nailing machine will incorporate a main body 10 having a front or forward end 12 and a rearward end 14, and having a handle 16, which is connectable by means of nipple 18 to any suitable source of compressed air. Typically, the handle 16 will be hollow, and within main body 10 a sleeve 20 provides a cylinder, within which a piston 22 is reciprocable by means of compressed air. Piston 22 is connected to an impact shaft 24, extending through the forward end 12 of the main body 10.

A barrel portion 26 extends forwardly from the forward end 12 of the main body 10, and extends downwardly to a muzzle end 28, which is adapted to be placed against a work piece. A central bore 30 extends through the barrel 26, for passage of a nail therethrough into the work piece.

By suitable means such as trigger 32, compressed air may be admitted to the cylinder 20 as desired. Return movement of the piston 22 after driving in of a nail, will be accomplished by compressed air, usually being admitted to the underside of the piston 22 when the trigger 32 is released.

Figure 2:
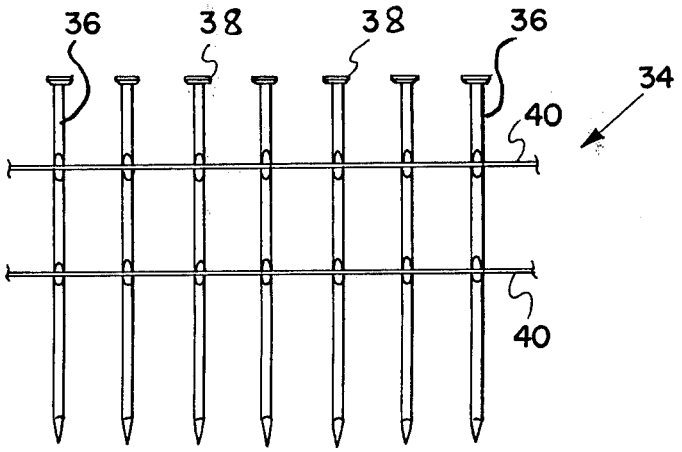
FIG. 2 is a side elevational view of a portion of a wire-bound nailing strip as used in the nailing machine of FIG. 1.

Nails are supplied in the form of a wire-bound nailing strip, indicated generally as 34 in FIG. 2. Individual nails 36, having heads 38 which are circular and flat in shape, are secured together by means of upper and lower wires 40, being attached thereto, for example, by spot welding. It will be noted that the nails 38 are spaced apart a distance equal to the width of their nail heads or somewhat greater, so that there is a relatively substantial spacing between them.

Typically, such nails will be wound into a coil and stored in any suitable drum-type magazine.

As shown in FIG. 1, a drum-type magazine suitable for storing a coil of such nails is shown generally as 42, having a removable lid 44 by means of which the supply of nails may be replenished.

Nails are fed from the drum 42 through the nail feed mechanism indicated generally as 46, such nail feed mechanism 46 being connected to the barrel 26, by any suitable means not shown.

Figure 3:
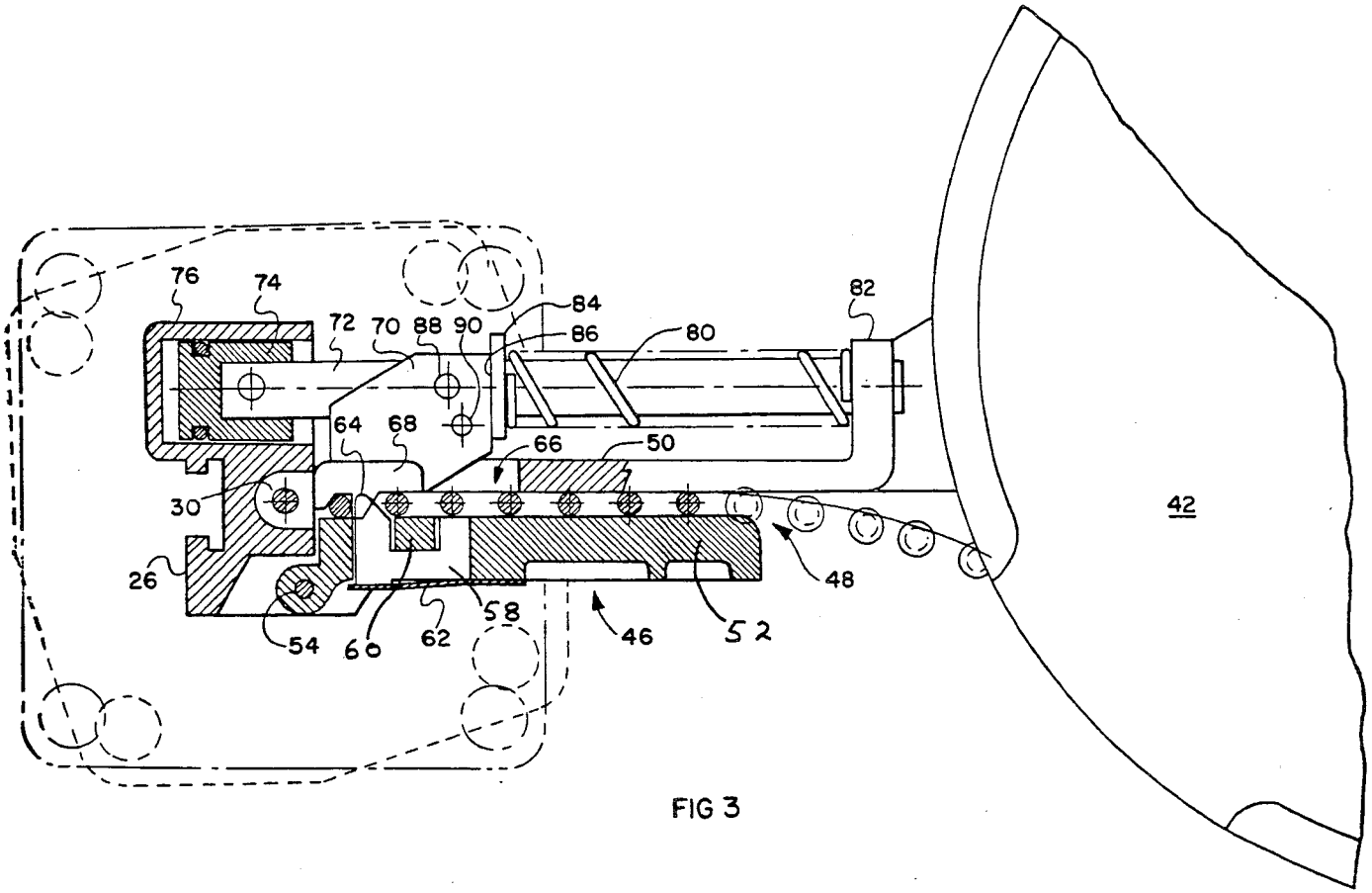
FIG. 3 is a top plan view in section along the line 3—3 of FIG. 1.
Figure 4:
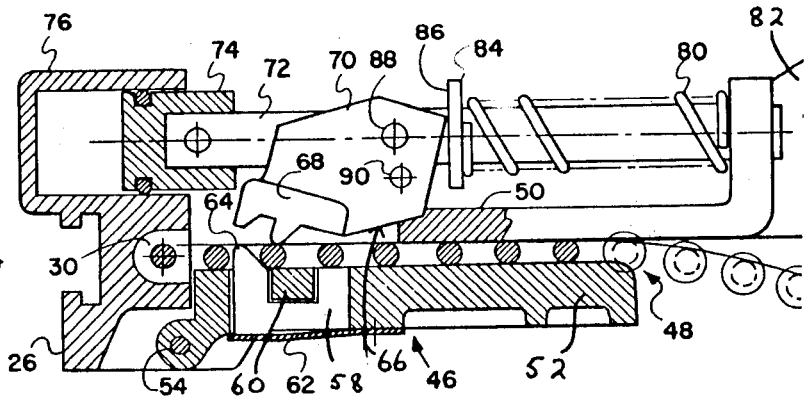
FIG. 4 is a top plan sectional view along the line 3—3, showing the parts in another position.
Figure 5:
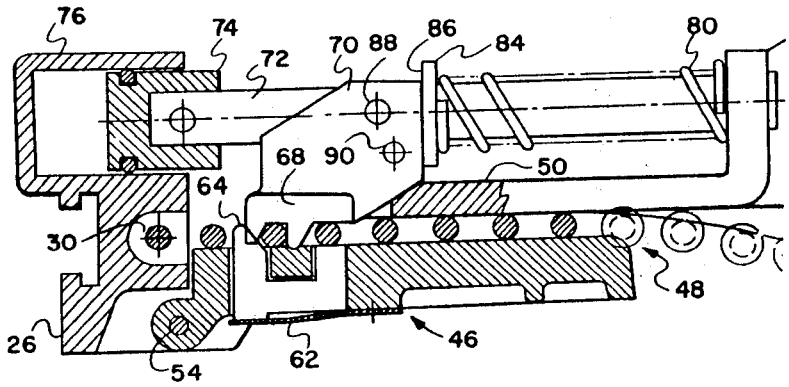
FIG. 5 is a top plan view along the line 3—3 showing the parts in still another position.

Referring now to FIGS. 3, 4 and 5, the nail feed mechanism 46 which supplies nails 36 into bore 30 of barrel 26 is shown in more detail. The nail feed mechanism 46 will be seen to comprise a nail feed channel 48, consisting of a fixed side wall 50, and a movable side wall 52, which are spaced apart from one another a distance equal to somewhat greater than the diameter of the nail shank, and have a suitable wider channel portion (not shown) for passage of the nail heads. There may also be suitable guide means in such channel (not shown) for guiding the wires 40 therein.

Side wall 52 is movably mounted on barrel 26, by means of pivot axis 54, so that it may be swung in a horizontal plane towards and away from side wall 50. This permits the feed channel 48 to be opened up, and cleared of obstructions, and also for the purpose of feeding a new nail strip therein, when the strip contained in magazine 42 has been used up.

A movable latching mechanism (not shown) is provided, by means of which the side wall 52 may be latched in its closed position during use.

Movably mounted within side wall 52 is an escapement ratchet lever 58, pivoted on post 60, and operated by a leaf spring 62. A tooth 64 on the free end of lever 58 fits between any two adjacent nails, and prevents the nailing strip from moving rearwardly—i.e. away from barrel 26 in channel 48. Tooth 64 has a ramp on its rearward or upstream side, so as to permit the nails in the nailing strip to be advanced towards barrel 26, the lever 58 swinging to flex spring 62, to permit such movement. However, tooth 64 prevents movement in the reverse direction.

Tooth 64 will, of course, become disengaged from the nailing strip when the entire side wall member 46 is swung away, about pivot 54.

The fixed side wall 50 is provided with a window or opening 66. Within the window 66, a nail advancing pawl 68 is located, having a two-part yoke 70 extending outwardly of window 66. The yoke 70 fits around opposite sides of an operating rod 72. One end of rod 72 is connected to a piston 74 running in pneumatic cylinder 76. The other end of rod 72 extends through spring 80, and through a suitable guide opening (not shown) in guide member 82. A washer 84 is provided on shaft 82, and bears against shoulders 86 on yoke 70. Yokes 70 are swingably fastened to rod 70 by means of pivot rod 88 extending through yokes 70 and through rod 72. A limit pin 90 also extends through yokes 70 but does not extend through rod 72, and functions to limit swinging movement of yoke 70 relative to rod 72.

Pawl 68 is best shown with reference to FIGS. 6 to 12.

Figure 6:
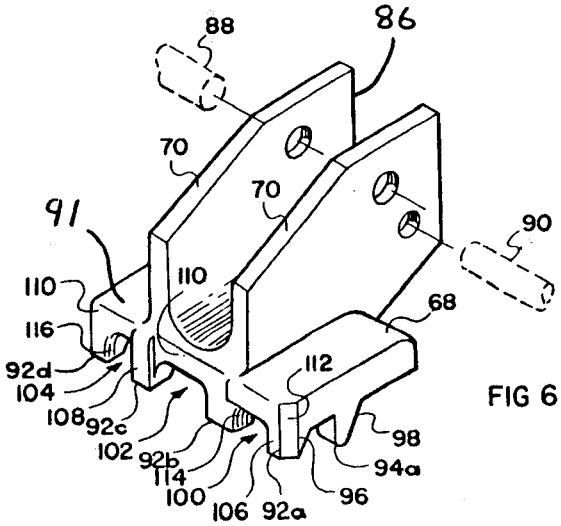
FIG. 6 is a perspective illustration of the nail feed pawl according to the invention.

As shown in FIG. 6, the pawl 68 consists of a generally flat planar, plate-like structure 91, on the side adjacent to yokes 70, and on its opposite side, it has a plurality of projecting teeth. Such teeth comprise the forward teeth 92*a, b, c,* and *d,* and the rearward teeth 94*a, b, c,* and *d.* Teeth 94 are somewhat longer than teeth 92. Both teeth 94 and teeth 92 have rearwardly or upstream directed ramped surfaces (shown in FIGS. 6 and 7 as 96 and 98). Note these references are omitted from FIGS. 8, 9, 10, 11 and 12 for the sake of clarity.

The forwardly directed surfaces of teeth 92 and 94 which are unreferenced, are substantially normal to the plane of pawl 68.

Three generally parallel axial grooves 100, 102 and 104 extend transversely across the face of pawl 68 between teeth 92 and 94. Grooves 100 and 104 are aligned with the two wires 40 in the nailing strip.

The forwardly directed faces of teeth 92*a* and 92*c* are provided with raised bosses 106 and 108, boss 106 being generally L-shaped and extending downwardly across the forwardly directed face of pawl 68, in the region of groove 100.

Between the raised bosses 106 and 108 the faces of the remaining teeth 92*b* and 92*d,* and the remaining intervening faces 110 of the pawl 68, are all relieved, and therefore lie in a different plane than that of bosses 106 and 108. (Note bosses 106 and 108 are omitted from FIGS. 3, 4 and 5 for the sake of simplicity).

Figure 12:
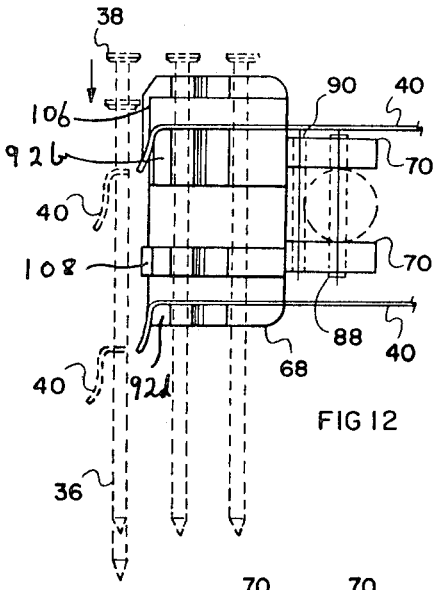
FIG. 12 is a side elevational view of the nail feed pawl, showing, in phantom form, a series of nails in a nailing strip, and showing the movement of the wire during driving of the end-most nail.
Figure 7:
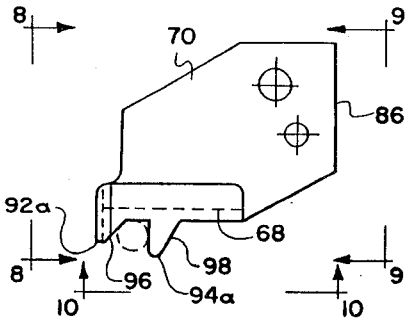
FIG. 7 is a top plan view of the nail feed pawl of FIG. 6.
Figure 8:
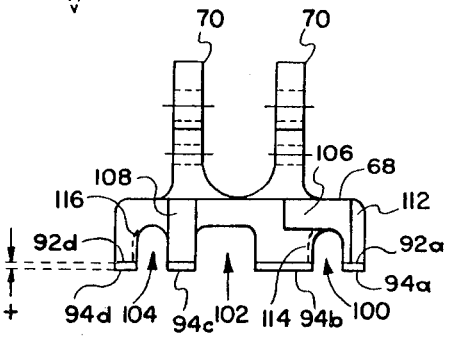
FIG. 8 is a elevational view of the front face of the nail feed pawl.
Figure 9:
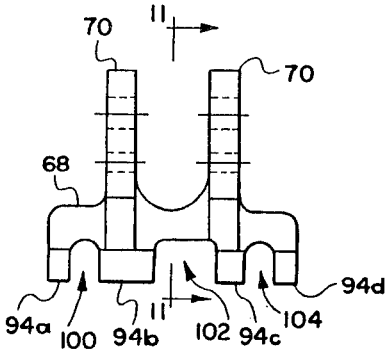
FIG. 9 is a rear elevational view of the nail feed pawl.
Figure 10:
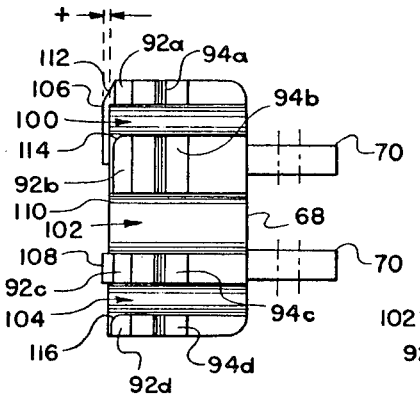
FIG. 10 is a side elevational view of the nail feed pawl.
Figure 11:
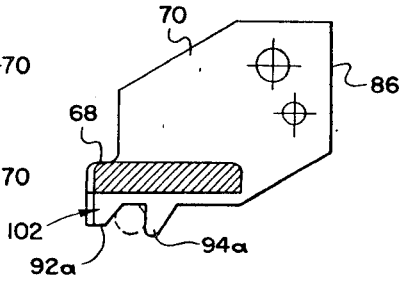
FIG. 11 is a section along the line 11—11 of FIG. 10.

Teeth 92*a* and 94*a* are normally located uppermost, in the position as shown in FIGS. 10 and 12. Thus, the heads 38 of the nails 36 will be located in a plane just above tooth 92*a*. When the endmost nail 36 is punched downwardly by the impact rod 24 in barrel 26, each nail head 38 will thus pass in succession past teeth 92*a*, 92*b*, 92*c* and 92*d*.

The upper forwardly directed shoulders 112 of tooth 92*a* is formed with an angled surface.

The upper forwardly directed shoulder of tooth 92*b* is formed with a rounded surface 114, and the upper forwardly directed shoulder of tooth 92*d* is also provided with a similar rounded surface 116.

These contoured radiussed surfaces 114 and 116 function to produce radiussed bends in the wires and cause them to break cleanly just where they join with the endmost nail. In order to fully protect the bent ends of wires 40 the recessed surfaces 110 should be spaced from raised bosses 106–108 in different planes, which are separated by a thickness "t" preferably equal to about 110% of the thickness of wire 40.

Cylinder 76 will, of course, be supplied with a source of compressed air, through any suitable aperture (not shown). Such compressed air may, for example, be carried in a suitable conduit 118 (FIG. 1), which is connected so as to be operated by the trigger 32 at an appropriate moment in the cycle of the nailing machine. The details of the operation of such trigger 32, and pneumatic cylinder 76, are essentially similar to those used in the prior art, and accordingly are not described further for the sake of simplicity.

In operation, it will of course be appreciated that the function of the piston 20 in cylinder sleeve 22, is responsive to operation of trigger 32, to drive rod 24 downwardly, in the same manner as in other such nailing guns.

As the rod 24 descends, it will strike the head of the endmost nail 36, which is located in the central bore 30 of barrel 26 of the device.

Rod 24 will thus drive such endmost nail downwardly, substantially as shown in phatom in FIG. 12. This will cause the wires 40 to bend downwardly around the contoured surfaces 114 and 116 of teeth 92*b* and 92*d* as shown in FIG. 12, and such wires will, in fact, break off from the endnost nail just where they are attached to such endmost nail.

The endmost nail then continues to descend. However, the head of such endmost nail is maintained out of contact with the free ends of wires 40, by virtue of the raised bosses 106 and 108 on teeth 92*a* and 92*c*, so that such bent over portions of wire are not sheared off by the descending nail head, but remain attached to the next nail in the coil.

As the endmost nail 36 is driven into the workpiece, the wire pieces attached to it may be driven into the wood, which is not harmful to the nailing gun, and will not cause it to jam.

At the same time as the air enters cylinder 20, air is admitted by passageways not shown, to cylinder 76, which causes piston 74 to be driven outwardly, thereby causing pawl 68, attached to rod 72, to be moved upstream relative to the nails 40.

The ramped surfaces 96 and 98 on teeth 92 and 94 will cause pawl 68 to be deflected away from the nails 36, being free to swing around pivot 88, against the action of spring 80.

Upstream movement of nails 40 is prevented by means of escapement tooth 64. Teeth 92 and 94 will then engage the next upstream nail 36, and, by automatic porting means (not shown) the air pressure in cylinder 76 is released. Spring 80 will then take over and drive rod 72, and pawl 68 in the downstream direction, causing downstream movement of the entire stick of nails 36, thereby advancing the next endmost nail 36 into the bore 30 of barrel 26 after rod 24 has moved into its upper position.

Such a downstream movement of nails 36 is permitted by tooth 64, which having a ramped surface, and being swingable away from nails 36, permits such downstream movement.

The nailing gun is then ready for the driving in of the next nail 36, which will occur as soon as the trigger is pulled once more.

It will thus be seen that breaking off of small pieces of wire is effectively prevented by means of the invention, and the wires are retained on the nails as they are driven out of the bore, thereby avoiding jamming of the mechanism by loose pieces of wire which frequently occurred in earlier machines.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A nail feed mechanism for use in power operated nailing guns of the type having a nail guiding barrel, a nail magazine, for carrying a strip of nails, wherein such nails are joined together in such strip by at least two lengths of wire, said nails being fastened to said wires at spaced intervals, said nail feed mechanism being located to one side of said barrel, for feeding said strip of nails from said magazine to said barrel, a driving member reciprocable within said barrel for driving nails, and power operated means for operating such driving member, thereby separating an endmost nail of said strip from said wires and driving same out of said barrel, and comprising;

means defining a nail feed channel for receiving said strip of nails;

nail feed pawl means reciprocable adjacent to such channel relative to such a strip of nails; pairs of forward and rear tooth members on such pawl means, and defining groove means between such pairs for reception of said wires interengageable with nails in such strip, whereby to advance the endmost nail in such strip into said barrel;

power operated means for operating said pawl means in timed relation to the operation of said driving member;

contoured surfaces on two of said forward teeth of said pairs around which said wires are bent over when said endmost nail is driven along said barrel by said driving member, and, spacer means on some of said forward teeth adjacent to said contoured surfaces, such spacer means maintaining such endmost nail out of contact with such bent over portions of such wires diring driving of such endmost nail.

2. A nail feed mechanism as claimed in claim 1 wherein there are four such forward tooth members and wherein said spacer means is formed at least partly on a first one of said forward tooth members, and wherein a second one of said forward tooth members adjacent said first forward tooth member is formed with a relieved surface, and wherein such second forward tooth member is also formed with such contoured surface.

3. A nail feed mechanism as claimed in claim 2 wherein further spacer means are formed on a third such forward tooth member, and wherein a fourth such forward tooth member is formed with a relieved surface and with a contoured surface.

4. A nail feed mechanism for use in power operated nailing guns of the type having a nail guiding barrel, a nail magazine, for carrying a strip of nails, wherein such nails are joined together in such strip by at least two lengths of wire spaced apart from each other, said nails being fastened to said wires at spaced intervals along such wires, said nail feed mechanism being located to one side of said guiding barrel, for feeding said strip of nails from said magazine to said barrel, a driving member reciprocable within said barrel for driving nails, and power operated means for operating such driving member, thereby separating an endmost nail of said strip from said wires and driving same out of said barrel, and comprising;

means defining a nail feed channel for receiving said strip of nails and communicating with such guiding barrel; channel relative to such a strip of nails abutment means on such pawl means interengageable with nails in such strip, whereby to advance the endmost nail in such strip into said guiding barrel; in such strip into said guiding barrel;

such abutment means being generally elongated and adapted to fit between two adjacent nails;

groove means arranged transversely of such abutment means for receiving said lengths of wire therein;

power operated means for operating said pawl means in timed relation to the operation of said driving member;

contoured surfaces on at least some of said abutment means adjacent such groove means, around which said wires are bent over at a predetermined radius of curvature when said endmost nail is driven along said barrel by said driving member whereby to flex both said wires between such endmost nail, and the next adjacent nail, and cause such wires to break adjacent said endmost nail, and, spacer means on said pawl means adjacent to said contoured surfaces, such spacer means maintaining such endmost nail out of contact with such bent over portions of such wires during driving of such endmost nail.

5. A nail feed mechanism as claimed in claim 1 including movable nail retaining means adjacent said channel, for engaging said nails in said strip and preventing reverse movement thereof away from said barrel.

6. A nail feed mechanism as claimed in claim 5 wherein said means defining said nail feed channel include fixed wall means on one side of said channel, and movable wall means on the other side of said channel, said movable wall means being movable between open and closed positions, and means for retaining same in said closed position, said nail retaining means being incorporated in said movable wall means.

7. A nail feed mechanism as claimed in claim 5 wherein said abutment means comprise pairs of forward and rear tooth members, said tooth members being separated by a predetermined spacing for receiving a said nail therebetween.

8. A nail feed mechanism as claimed in claim 7 wherein said pairs of tooth members are located in planes spaced apart from adjacent said tooth members, and defining grooves therebetween for reception of said wires therein.

9. A nail feed mechanism as claimed in claim 8 wherein said spacer means are formed on at least one of said forward teeth of one of said pairs, and wherein at least one other forward tooth of a said pair is formed with a relieved surface.

* * * * *